US009491991B1

(12) United States Patent
Rong et al.

(10) Patent No.: US 9,491,991 B1
(45) Date of Patent: Nov. 15, 2016

(54) WATCH FASTENER AND WATCH BAND USING THE WATCH FASTENER

(71) Applicants: HONGFUJIN PRECISION ELECTRONICS (ZHENGZHOU) CO., LTD., Zhengzhou (CN); HON HAI PRECISION INDUSTRY CO., LTD., New Taipei (TW)

(72) Inventors: Yu-Jie Rong, Shenzhen (CN); Qiao-Zhen Bai, Shenzhen (CN); Bo Yang, Shenzhen (CN); Er-Li Jia, Shenzhen (CN); Jian-Tao Ding, Shenzhen (CN); Yan-Lei Cao, Shenzhen (CN)

(73) Assignees: HONGFUJIN PRECISION ELECTRONICS (ZHENGZHOU) CO., LTD., Zhenghou (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/876,247

(22) Filed: Oct. 6, 2015

(30) Foreign Application Priority Data

Jun. 24, 2015 (CN) ..... 2015 1 0352377

(51) Int. Cl.
*A44C 5/18* (2006.01)
*A44C 5/20* (2006.01)

(52) U.S. Cl.
CPC ..... *A44C 5/2071* (2013.01); *A44C 5/18* (2013.01); *Y10T 24/42* (2015.01)

(58) Field of Classification Search
CPC ..... A44C 5/18; A44C 5/2071; Y10T 24/42
See application file for complete search history.

(56) References Cited

U.S. PATENT DOCUMENTS 2,538,265 A * 1/1951 Paston ..... A44C 5/0053 224/176
3,109,212 A * 11/1963 Edgar ..... B65D 63/14 24/16 PB
3,160,158 A * 12/1964 Rayhart ..... A61M 25/02 128/DIG. 26
3,929,265 A * 12/1975 Pyne ..... A44C 5/16 224/178
4,221,063 A * 9/1980 Charles ..... G09F 3/005 283/75
4,427,328 A * 1/1984 Kojima ..... F16B 21/084 24/625
4,464,854 A * 8/1984 Hall ..... G09F 3/005 119/857
4,581,793 A * 4/1986 Micklitz ..... A63H 33/102 24/297
4,805,272 A * 2/1989 Yamaguchi ..... A41H 37/001 24/623
4,805,273 A * 2/1989 Burke ..... A41H 37/04 24/104
4,819,309 A * 4/1989 Behymer ..... F16B 3/00 24/586.11
D324,649 S * 3/1992 Lederhaus, Jr. ..... D8/391
5,226,809 A * 7/1993 Franco ..... A44B 17/0029 24/662
5,448,846 A * 9/1995 Peterson ..... G09F 3/005 24/484
5,831,535 A * 11/1998 Reisman ..... G07C 9/00111 340/572.1
5,933,929 A * 8/1999 Kawakami ..... A44B 17/0035 24/324
6,371,293 B2 * 4/2002 Kubota ..... 140/93.2
D462,257 S * 9/2002 Alexander ..... D8/391
7,045,715 B2 * 5/2006 Ono ..... B60R 16/0215 174/135
7,698,836 B2 * 4/2010 Schmelzer ..... A43B 3/0078 24/114.11
7,872,588 B2 * 1/2011 Potter ..... G08B 21/0286 2/338
8,088,043 B2 * 1/2012 Andren ..... A63B 24/00 368/10
8,122,519 B2 * 2/2012 Schmelzer ..... A42B 1/24 2/1

(Continued)

*Primary Examiner* — Justin Larson
(74) *Attorney, Agent, or Firm* — Zhigang Ma

(57) ABSTRACT

A watch fastener for fastening a watch strap or band includes a base portion, a first column, and a head portion. The base portion and the head portion lie at opposite ends of the first column and the intersection of a central axis of the first column with a central axis of the base portion is oblique. The first column perpendicularly intersects the head portion.

8 Claims, 5 Drawing Sheets

(56) References Cited

U.S. PATENT DOCUMENTS

| | | | | |
|---|---|---|---|---|
| 8,191,209 | B2 * | 6/2012 | Wolfgang | A44C 5/16 224/180 |
| 8,250,796 | B2 * | 8/2012 | Padgett | G09F 3/005 283/75 |
| 8,408,436 | B2 * | 4/2013 | Berry | A63B 24/00 224/176 |
| 8,574,205 | B2 * | 11/2013 | Biry | A61B 17/20 119/654 |
| 8,590,192 | B2 * | 11/2013 | Padgett | A44C 5/0069 283/75 |
| 8,763,869 | B2 * | 7/2014 | Gerard-Goddet | A44C 5/0053 224/164 |
| 8,834,058 | B2 * | 9/2014 | Woicke | B01J 19/32 24/662 |
| 8,919,019 | B2 * | 12/2014 | Martinez | G06F 15/00 224/164 |
| 9,314,072 | B2 * | 4/2016 | Lee | A44B 11/24 |
| 2009/0265971 | A1 * | 10/2009 | Cook | G09F 3/005 40/633 |
| 2010/0331145 | A1 * | 12/2010 | Lakovic | G04F 10/00 482/8 |
| 2013/0219960 | A1 * | 8/2013 | Gerard-Goddet | A44C 5/0053 63/3.2 |
| 2013/0227988 | A1 * | 9/2013 | Padgett | A44C 5/14 63/1.13 |
| 2013/0298353 | A1 * | 11/2013 | Drane | B65D 63/1063 24/16 PB |
| 2015/0241917 | A1 * | 8/2015 | Seok | A61B 5/681 361/679.03 |
| 2015/0265034 | A1 * | 9/2015 | Lee | A45F 5/00 224/219 |

* cited by examiner

WATCH FASTENER AND WATCH BAND USING THE WATCH FASTENER

CROSS-REFERENCE TO RELATED APPLICATIONS

This application claims priority to Chinese Patent Application No. 201510352377.8 filed on Jun. 24, 2015, the contents of which are incorporated by reference herein.

FIELD

The subject matter herein generally relates to strap fasteners.

BACKGROUND

Generally, a watch fastener is used to clasp two ends of a watch band together around a wrist. When the watch band is made of rubber or leather, a watch fastener is usually a buckle and pin. A number of through holes are predefined on the band. The pin is passed through one of the through holes to clasp two ends of the band.

BRIEF DESCRIPTION OF THE DRAWINGS

Implementations of the present technology will be described, by way of example only, with reference to the attached figures, wherein.

DETAILED DESCRIPTION

Figure 1:
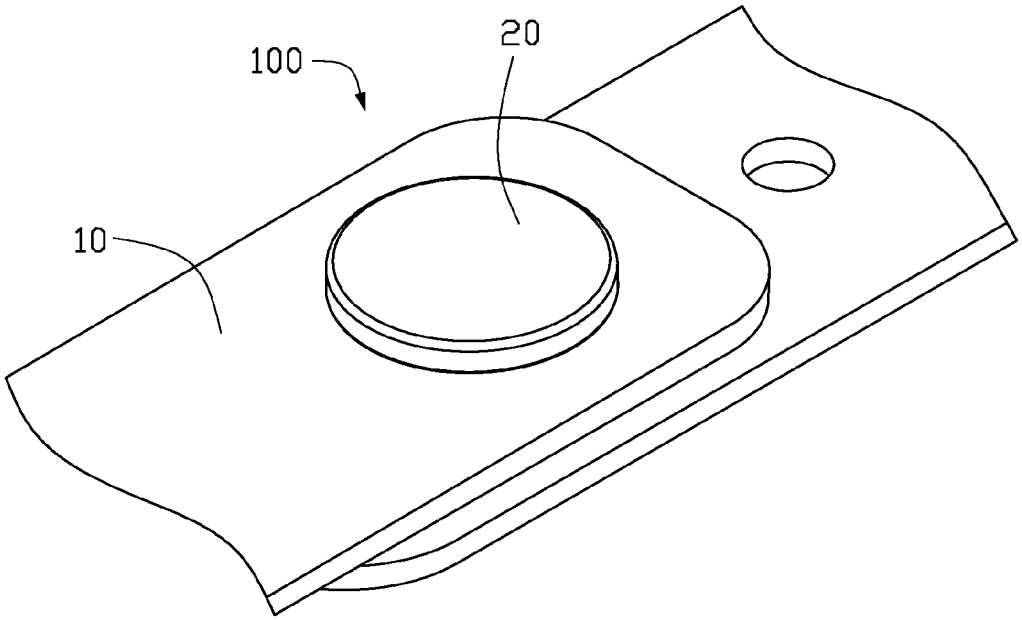
FIG. 1 is an isometric view of one embodiment of a watch band.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising," when utilized, means "including, but not necessarily limited to"; it specifically indicates open-ended inclusion or membership in the so-described combination, group, series and the like.

Figure 2:
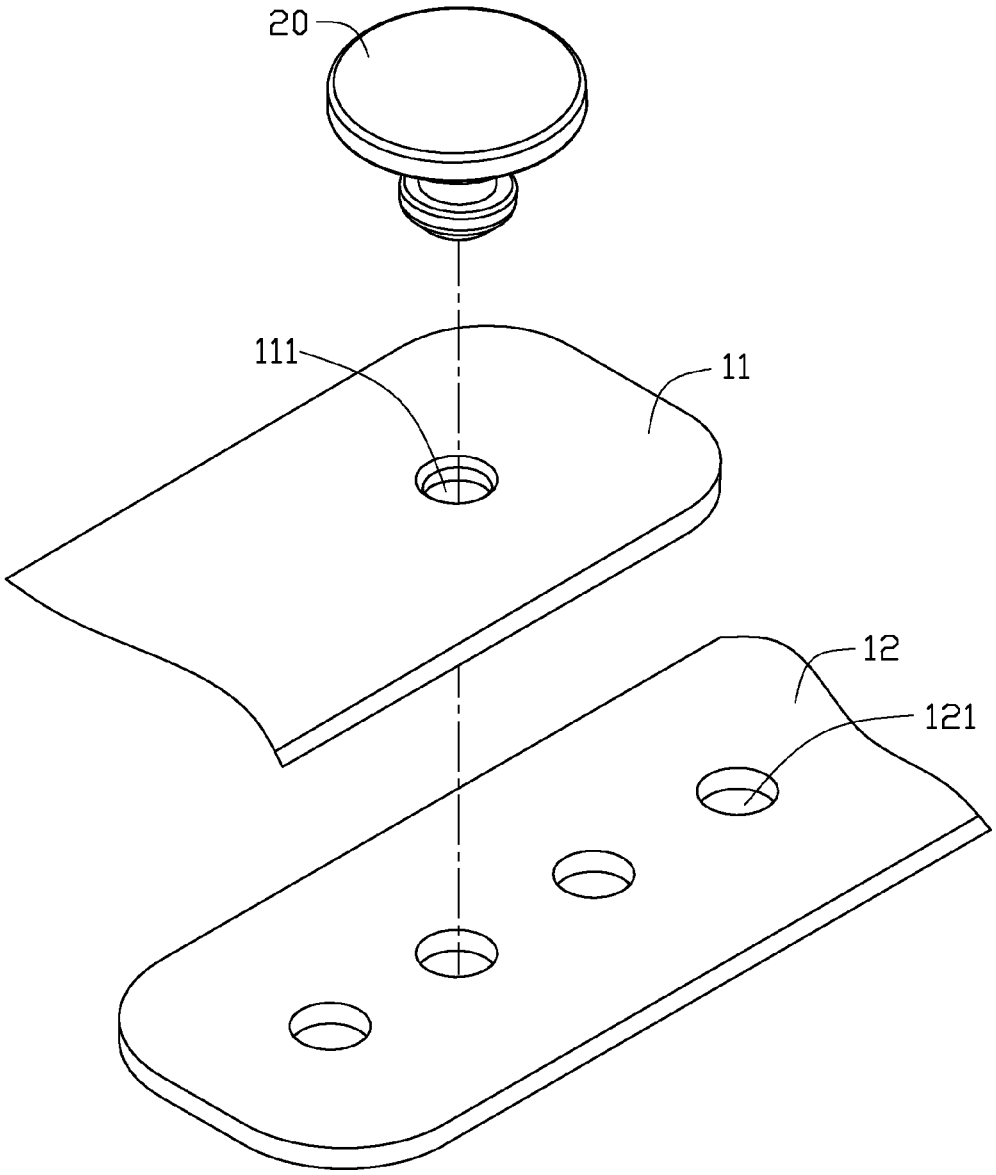
FIG. 2 is an exploded, perspective view of the watch band of FIG. 1.

FIG. 1 illustrates a watch band. FIG. 2 illustrates an exploded isometric view of the watch band of FIG. 1. This watch band 100 can include a band body 10 and a watch fastener 20. The watch fastener 20 is fastened to the band body 10. The band body 10 can include a first end 11 and a second end 12. The first end 11 can include at least one first buckle hole 111 and the second end 12 can include a number of second buckle holes 121. The watch fastener 20 fastens the first end 11 and the second end 12 of the band body 10 together when the watch fastener 20 passes through the first buckle hole 111 and one of the second buckle holes 121. A watch (not shown) affixed on the band body 10 can be worn on a wrist of a user.

Figure 3:
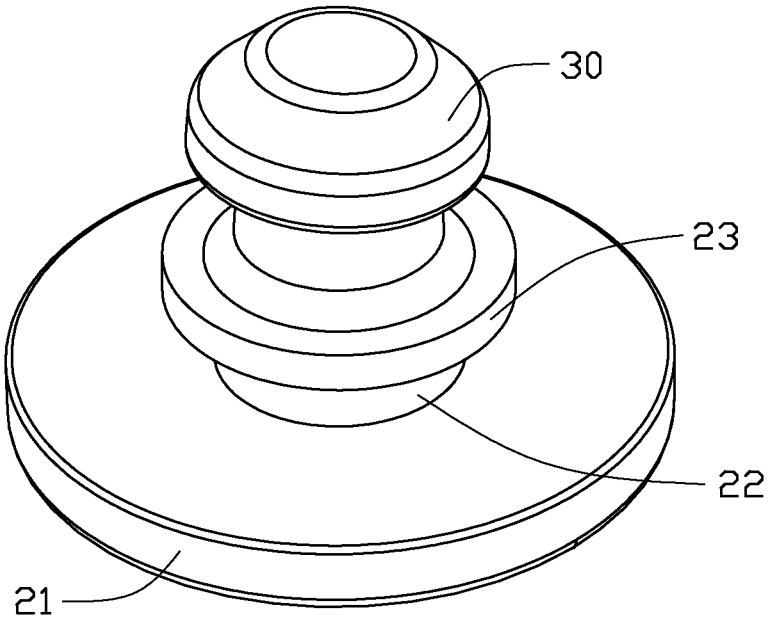
FIG. 3 is an isometric, perspective view of a watch fastener of FIG. 2.
Figure 4:
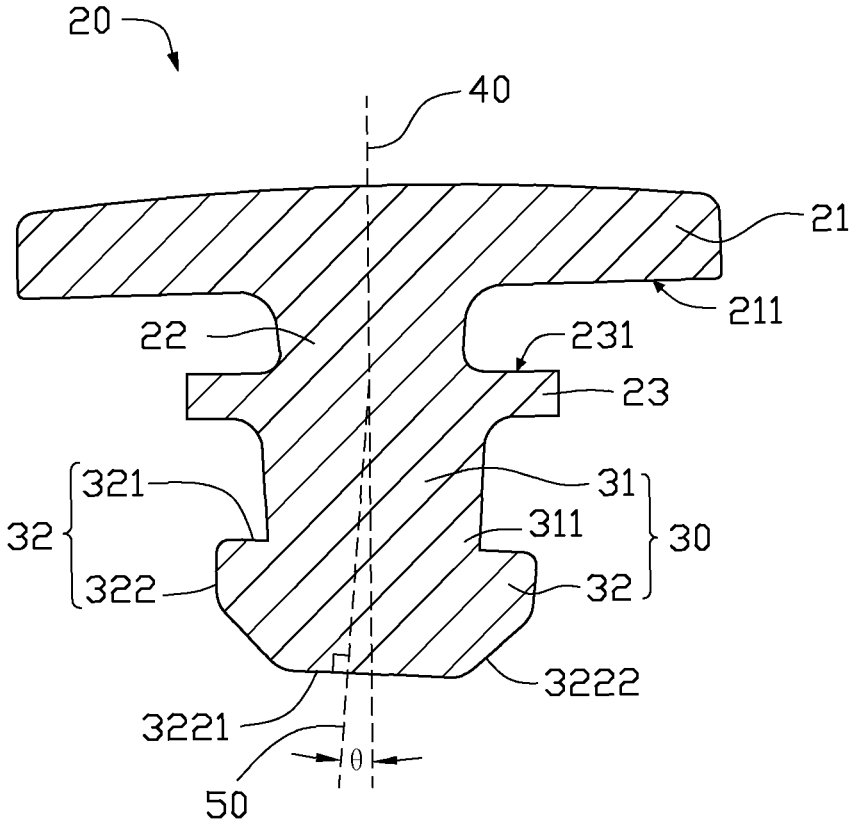
FIG. 4 is a cross sectional view of the watch fastener of FIG. 2.

FIG. 3 illustrates an isometric perspective view of the watch fastener 20. FIG. 4 illustrates a cross sectional view of the watch fastener illustrated in FIG. 2. The watch fastener 20 includes a top portion 21, a connection portion 22, a base portion 23, and a fastening component 30. The top portion 21 is parallel with the base portion 23. The connection portion 22 can be connected between the top portion 21 and the base portion 23. Moreover, the connection portion 22 is substantially perpendicular to the top portion 21 and the base portion 23. The connection portion 22 and the fastening component 30 can be arranged at two opposite sides of the base portion 23.

In at least one embodiment, the top portion 21 can be a shape similar to that of the base portion 23. The size of the top portion 21 can be bigger than that of the base portion 23. In other embodiments, the shapes of the top portion 21 and the base portion 23 can be different.

In at least one embodiment, the top portion 21 and the base portion 23 are disk-shaped, and a diameter of the top portion 21 is bigger than a diameter of the base portion 23. In other embodiments, the shapes of the top portion 21 and the base portion 23 can be, but are not limited to being, cross-shaped, in the shape of a "W", or in the shape of a "T".

The fastening component 30 can include a first column 31 and a head portion 32. The first column 31 extends from the base portion 23. The head portion 32 can be arranged at a first end 311 of the first column 31. The first end 311 is away from the base portion 23. The shape of the head portion 32 can be configured to be easy to combine with one of the buckle holes 121 to fasten the band body 10. In another embodiment, the buckle holes 121 on the second end 12 of the band body 10 may be replaced with buckle holes or buckle rings on decorations, such as bracelets or necklaces. In another embodiment, these elements may be used to secure straps or bands on clothes such as hats or sleeves.

The head portion 32 includes a first surface 321 and a second surface 322. The first surface 321 perpendicularly intersects with the first end 311 of the first column 31. The first column 31 obliquely intersects with the base portion 23. FIG. 4 illustrates a locational relationship between the first column 31 and the base portion 23. As shown in FIG. 4, a preset angle θ is formed between a central axis 50 of the first column 31 and a central axis 40 of the base portion 23. The angle θ can be adjusted according to need. The preset angle θ is governed by material of the watch fastener 20. In the embodiment, the watch fastener 20 can be made of flexible and molded thermoplastic, for example, polyolefin plastics, polyurethane plastics, or vinyl plastics. In the embodiment, all parts of the watch fastener 20 can be made by injection molding.

In at least one embodiment, the first column 31 and the connection portion 22 are cylindrical. In other embodiments, the first column 31 and the connection portion 22 are triangular or rectangular to match with the shape of the buckle holes of other fasteners.

The cross section of a cylindrical column can be round, the cross section of a triangular column would be three-sided, and the cross section of a square or rectangular column would be four-sided.

In at least one embodiment, the height of the connection portion 22 is equal to thickness of the band body 10. When the base portion 23 of the fastener 20 passes through the buckle hole 111, the top surface 231 of the base portion 23 and the bottom surface 211 of the top portion 21 make contact with the band body 10, thereby the fastener 20 is firmly fastened together with the first end 11 of the band body 10.

Figure 5:
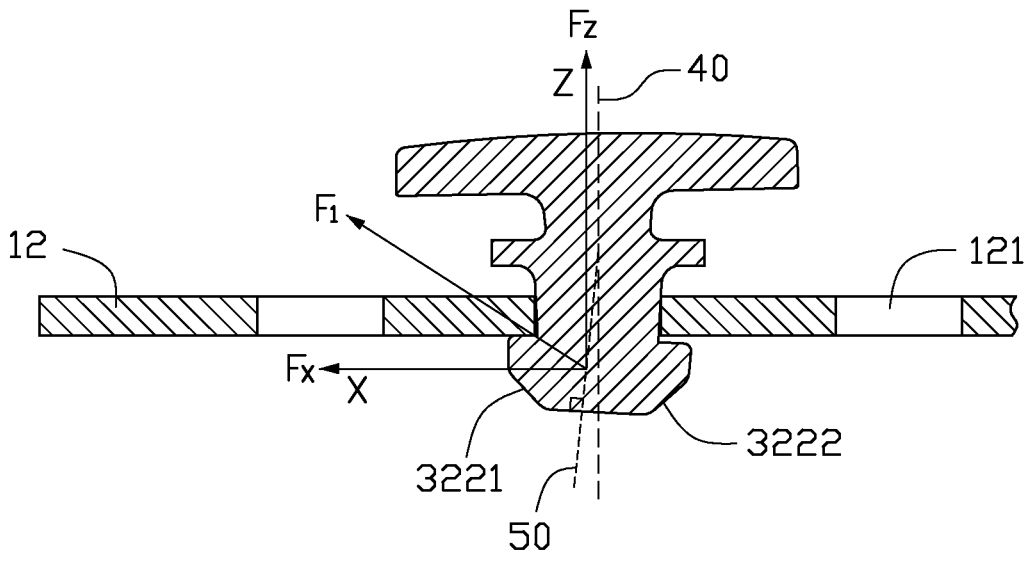
FIG. 5 is a partial cross sectional view of the watch fastener and the watch band fastened together.

FIG. 5 illustrates the watch fastener 20 being fastened with the watch band 100. As the intersection of the central axis 50 of the first column 31 with the central axis 40 of the base portion 23 is oblique, a first outside surface 3221 of the head portion 32 is located higher than a second outside surface 3222 of the head portion 32. The head portion 32 is not located in a same horizontal plane, but in an inclined plane. The head portion 32 is inserted into the buckle holes 121 of the second end 12 via elastic deformation of the head portion 32. In an alternative embodiment, the head portion 32 is a dome shape.

In other embodiments, the head portion 32 can be, but is not limited to being, a "W" shape, a "T" shape, in the shape of a cross, a square shape, or a rectangular shape. The shape of the head portion 32 facilitates the combination of the fastener 20 with other fasteners.

When in use, the base portion 23 of the fastener 20 passes through the buckle hole 111 of the first end 11 of the band body 10, and the top surface 231 of the base portion 23 and the bottom surface 211 of the top portion 21 make contact with the band body 10, the fastener 20 is thus firmly fastened with the first end 11 of the band body 10. Then, the second outside surface 3222 of the head portion 32 makes contact with the buckle holes 121 of the second end 12. The second outside surface 3222 is deformed and inserted into the buckle hole 121 when a force is exerted on the fastener 20. The first outside surface 3221 is pushed into the buckle hole 121. The head portion 32 passes through the buckle hole 121. Then, a slight compressive force is applied to the fastener 20, so the first surface 321 of the head portion 32 and the first column 31 make contact with the buckle hole 121. In this condition, the fastener 20 fastens the first end 11 and the second end 12 together.

As illustrated by FIG. 5, after the fastening component 30 fastens the band body 10; the first column 31 can generate a first force F1 on the band body 10, as the first column 31 is in an inclined state. Under the action of the first force F1, the fastening component 30 has an effect on the band body 10 in the Cartesian X and Z axes. In particularly, the effect Fz of the first force F1 in the Z axis can enhance the support of the head portion 32 for the band body 10. Therefore, the band body 10 can be more firmly fastened together with the fastener 20. Furthermore, the effect Fz of the first force F1 in the Z axis avoids the band body 10 moving away from, or falling off, the band body 10. In at least one embodiment, after the fastening component 30 fastens the band body 10, however, the first column 31 of the fasten component 30 does not make contact with the band body 10. In this condition, only the head portion 32 can generate a second force (not shown in drawings) to the band body 10 in the Z axis. Under the action of the second force, the head portion 32 has the effect of supporting the band body 10. With the support of the second force, the band body 10 is prevented from falling off the band body 10.

When the band body 10 needs to be removed, the material of the fastener 20 or the band 100 is deformed as the second outside surface 3222 of the head portion 32 is firstly squeezed into the buckle hole 121 by a pulling force. The first outside surface 3221 of the head portion 32 is brought by the second outside surface 3222 through the buckle hole 121. As the pulling force is continued, the head portion 32 is pulled out of the buckle hole 121 and the first end 11 of the band body 10 is separated from the second end 12 of the band body 10.

In the illustrated embodiment, the fastener 20 only includes the base portion 23 and the fastening component 30. When the band body 10 is to be fastened on a wrist of a user, a force is applied on the fastener 20 to cause the head portion 32 of the fasten component 30 to pass through the buckle hole 111 on the first end 11 of the band body 10. The continuation of such force causes the head portion 32 of the fasten component 30 to pass through the buckle hole 121 on the second end 12. Thus, the head portion 32 of the fastener 20 is positioned under the second end 12, namely, the second end 12 is positioned on the head portion 32. In this condition, the first end 11 and the second end 12 of the band body 10 are fastened together. When the band body 10 needs to be removed, the material of the fastener 20 or the band 100 can be deformed by a pulling force, and the head portion 32 is separated from the second end 12 of the band body 10.

In other embodiments, the fastener 20 is integrated and fixed on one end of the band body 10, such as on the first end 11. The fastening component 30 is integrated with the first end 11, and fastens the buckle hole 121 on the second end 12 of the band body 10.

In another embodiment, the fastener 20 is further used for a band body. A first end and a second end of the band body are affixed to other items to wear, such as shoes, bag, hat, coat, and so on. The first end or the second end of the band body are equipped with fastening components such as buckle holes or buckle rings and the fastener 20 passes through the fastening components to fasten the first end and the second end of the band body together.

The embodiments shown and described above are only examples. Many details of such fasteners are found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A watch fastener comprising:

a base portion;

a first column extending from the base portion; and a head portion, wherein the base portion and the head portion are respectively arranged at two opposite ends of the first column;

wherein the first column having a central axis that obliquely intersects with a central axis of the base portion, and the first column substantially perpendicularly intersects the head portion.

2. The watch fastener according to claim 1, wherein a preset angle is formed between the central axis of the first column and the central axis of the base portion.

3. The watch fastener according to claim 1, wherein the watch fastener is made from flexible and molded thermoplastic.

4. The watch fastener according to claim 1, further comprising: a connection portion extending away from the base portion and a top portion arranged at a distal end of the connection portion away from the base portion, wherein the top portion is parallel with the base portion, and the connection portion perpendicularly intersects with the top portion and the base portion.

5. A watch band comprising:

a band body; and a watch fastener fastened the watch body; wherein the watch fastener comprises:

a base portion;

a first column extending from the base portion; and a head portion arranged at one end of the first column away from the base portion;

wherein a central axis of the first column obliquely intersects with a central axis of the base portion, and the first column is substantially perpendicular to the head portion.

6. The watch band according to claim 5, wherein a preset angle is formed between the central axis of the first column and the central axis of the base portion.

7. The watch band according to claim 5, wherein the watch fastener is made from flexible and molded thermoplastic.

8. The watch band according to claim 5, further comprising: a connection portion extending away from the base portion and a top portion arranged at a distal end of the connection portion away from the base portion, wherein the top portion parallels with the base portion, and the connection portion perpendicularly intersects with the top portion and the base portion.

* * * * *